United States Patent [19]

Treiber

[11] Patent Number: 4,958,479

[45] **Date of Patent: * Sep. 25, 1990**

[54] PACKAGE WRAPPING METHOD AND MACHINE

[75] Inventor: Fritz F. Treiber, Centerville, Ohio

[73] Assignee: Hobart Corporation, Troy, Ohio

[ * ] Notice: The portion of the term of this patent subsequent to Mar. 21, 2006 has been disclaimed.

[21] Appl. No.: 295,170

[22] Filed: Jan. 9, 1989

Related U.S. Application Data

[63] Continuation-in-part of Ser. No. 96,879, Sep. 15, 1987, Pat. No. 4,813,211.

[51] Int. Cl.[5] ..... B65B 11/18; B65B 57/04

[52] U.S. Cl. ..... 53/441; 53/464; 53/66; 53/223; 53/556

[58] Field of Search ..... 53/441, 464, 222, 223, 53/228, 230, 232, 556, 66

[56] References Cited

U.S. PATENT DOCUMENTS

| | | | |
|---|---|---|---|
| 2,611,224 | 9/1952 | Jensen | 53/66 X |
| 2,761,176 | 9/1956 | Knapp | 53/66 |
| 3,251,171 | 5/1966 | Lagesse | 53/66 |
| 3,967,433 | 7/1976 | Bonfiglioli | 53/228 X |
| 4,217,744 | 8/1980 | Mizutani | 53/66 X |
| 4,510,731 | 4/1985 | Mathieu | 53/66 |
| 4,522,013 | 6/1985 | Hamilton | 53/230 X |
| 4,583,348 | 4/1986 | Treiber | 53/556 X |

FOREIGN PATENT DOCUMENTS 2410601 6/1979 France .

*Primary Examiner*—John Sipos

*Attorney, Agent, or Firm*—Russell L. McIlwain; William Weigl

[57] ABSTRACT

An elevator package wrapping machine comprises a film gripper for initially drawing fixed lengths of film into the machine. While the film is held by the film gripper and side clamps, a package is elevated into the film such that the height of the package draws a first addition to the film drawn by the gripper, if required. Film side and rear underfolders fold the lateral edges of the film and the rear edge of the film extending from the film source under the packages, respectively. A film cutter is provided for severing the film from its source as the packages are being wrapped, and the cutter is controlled such that the timing of its operation is based on package length. By timing the operation of the film cutter to correspond to package length, a second film addition may be drawn by the rear underfolder during package wrapping, if required. Since the film may be cut on the fly as it is being drawn by the rear underfolder, the cutter preferably comprises a heated member and a brake which is applied to the film prior to severance such that the film is substantially stopped and stretched to thereby be cleanly severed and retract from the heated member to prevent fouling.

8 Claims, 5 Drawing Sheets

PACKAGE WRAPPING METHOD AND MACHINE

CROSS-REFERENCE TO RELATED APPLICATION

This application is a Continuation-In-Part of Ser. No. 096,879 filed Sept. 15, 1987 now U.S. Pat. No. 4,813,211.

BACGROUND OF THE INVENTION

This invention relates generally to packaging machines for wrapping stretch film around products supported upon trays, and more particularly, to a package wrapping method and machine wherein a single fixed length of wrapping material is initially drawn, with the ultimate film length used to wrap each package being determined by the height of the package and the length of the package.

A variety of machines are available for wrapping film about trayed products, for example meats and produce in supermarkets, to prepare attractive packages for consumer display. Two early examples of such machines are illustrated in U.S. Pat. Nos. 3,662,513 and 3,967,433, both of which disclose using only a fixed length of stretchable film. Such fixed film length wrapping wastes film and can potentially create unsightly clumps of film on the bottom of the smaller sized packages resulting in weak bottom seals and leaking packages.

To overcome the problems created by using a single fixed length stretchable film sheet for wrapping all packages, film wrapping machines have been developed which permit the selection of a variety of film lengths to accommodate varying package sizes. An example of an automatic film length selection mechanism for a film wrapping machine is disclosed in U.S. Pat. No. 4,510,731. In this patent, an adjustable mechanism is controlled in response to the measured length and height of a package to control the film drawing stroke of a film gripper to select the appropriate length of film for wrapping the package. Unfortunately, the adjustable mechanism is complicated mechanically and requires an adjusting control motor, sensing switches and control electronics to vary automatically the lengths of film drawn into the machine. Accordingly, while the adjustable mechanism is a substantial improvement over the fixed film length wrapping of the prior art, it does entail expense both for the initial components and also for continuing maintenance, particularly as the mechanism ages.

Another film sheet sizing arrangement is disclosed in French Publication No. 2,410,601 wherein a film sheet is held across the path of an obliquely raised elevator. In the French publication, a package is placed on the elevator and obliquely raised into and through a plane defined by the film to thereby draw any additional film which is required by the height of the package from a continuous source of the film. The obliquely raised elevator comprises a collapsible surface which is sequentially replaced by a film underfolder to thereby support the package and permit the elevator to be lowered for the next package to be wrapped. The film sheet is sized by severing the sheet only after the underfolder has been entirely inserted under the package to position the severed film end at a film holding mechanism for the next package. The leading and trailing edges of the film are brought together to form an overlapping sleeve arrangement for wrapping the package. Unfortunately, the film sheeting arrangement disclosed in the French publication results in a double overlap sleeve wrapping which wastes film relative to the wrapping arrangement of the present wrapping machine, and still entails complicated mechanical arrangements which are expensive from both a production and maintenance standpoint.

Accordingly, it is apparent that the need exists for an improved package wrapping method and machine which eliminate the complicated prior art sheeting arrangements, yet still provide film lengths selected in response to package dimensions to conserve film and provide attractive film wrapping characteristics.

SUMMARY OF THE INVENTION

In accordance with the present invention, the substantial manufacturing and maintenance costs associated with the complicated mechanisms heretofore required to perform multilength film sheeting have been eliminated by initially drawing only a single length of film from a continuous source of film into the wrapping machine, permitting the package height to draw a first film addition from the source, if required, and finally sheeting the film by film severance from the continuous source of film in response to the lengths of the packages to be wrapped such that a second film addition corresponding to the package length is drawn by the wrapping process, if required.

In accordance with one aspect of the present invention, a method for wrapping packages in stretch film comprises operating a conveyor to carry a package of designated length to an elevator of a wrapping station and to locate the package at a registration position on one side of the elevator. The registration position may be either toward the operator, in accordance with one embodiment, or toward either side of the machine. A free end of a continuous source of stretch film is gripped on the side of the elevator opposite to the side including the registration position and drawn over the elevator to a defined position beyond the registration position. Side clamps are operated to engage the lateral edges of the film over the elevator and moved outwardly to stretch laterally the film over the elevator. The package is elevated into the film to further stretch the film and draw any additional film required by the height of the package. A horizontal bar, which may be a rear underfolder, is moved into contact with the film at a location between the package and the film source to pull from the film source a second length of additional film corresponding to the designated length of the package. Side underfolders are operated to fold the lateral edges of the film under the package and the rear edge of the film under the package. The side clamps are released substantially upon engagement of the film by the side underfolders and the rear edge of the film is severed from the continuous source of film to produce a sheet of film of suitable length for the length of the package being wrapped. The package is ejected from the wrapping station to fold the originally gripped free end of film under the package and the originally gripped free end of film is released as the package is ejected from the wrapping station.

The method may further comprise drawing additional film from the continuous source by means of the rear underfolder, with the step of severing the film being performed as the additional film is being drawn into the machine. While the wrapping machine operator may manually designate the length of one or a series of packages being wrapped by the machine, preferably, the method further comprises measuring the length of each package as it is carried to the wrapping station such that the package length required to determine the film severing time is automatically determined for each package to be wrapped.

In accordance with another aspect of the present invention, a package wrapping machine including improved film sheeting apparatus comprises film gripper means for drawing a fixed length of film into the machine. Package wrapping means are provided for enveloping a package in the drawn film and a film underfolder folds the film end extending from the continuous source under the package. Film cutter means are provided for severing the film from the continuous source as the package is being wrapped and cutter control means provide for timing the operation of the film cutter means based on the length of the package. Accordingly, the total length of film drawn from the continuous source is determined by the time of operation of the film cutter means such that sufficient film is drawn to cover the bottoms of packages being wrapped.

It is a primary object of the present invention to provide an improved package wrapping method and machine wherein a fixed film length is always initially drawn, packages are elevated into and through the film to stretch and thereby draw a first film addition from a continuous source as required by the height of the package, and a horizontal bar is moved into contact with the film to pull from the film source a second film addition as required by the length of the package.

Other objects and advantages of the invention will be apparent from the following description, the accompanying drawings and the appended claims.

DETAILED DESCRIPTION OF THE INVENTION

Figure 1:
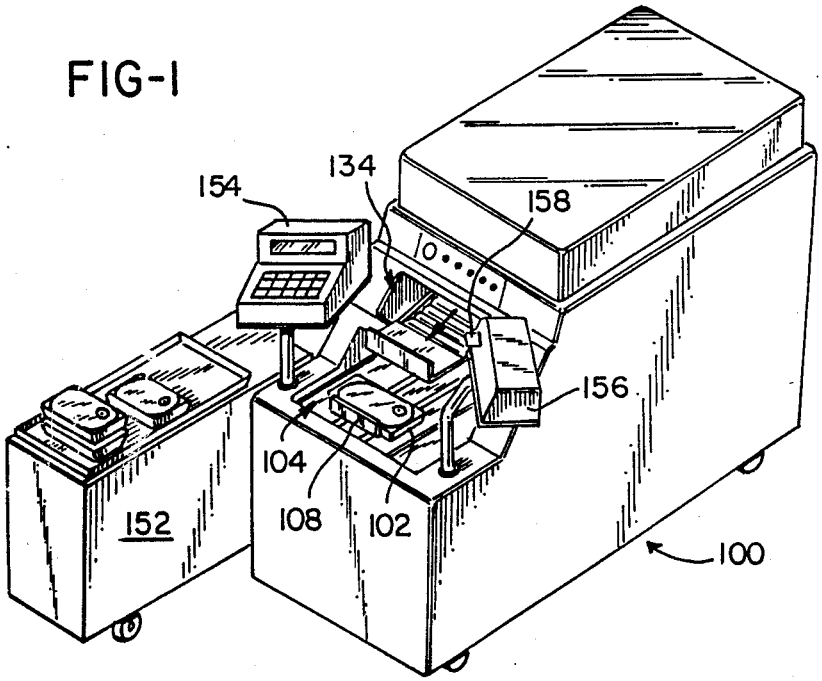
FIG. 1 is a perspective view of a package wrapping and weighing machine embodying the invention of the present application.

The general operation of a package wrapping and weighing machine 100 incorporating the present invention will be described with reference to FIGS. 1–5. A package 102 comprising, for example, meat, produce or other food products placed upon a tray is to be wrapped in stretchable heat-sealable film, weighed and labeled for attractive display. The package 102 is placed in a package infeed station 104 from which it is conveyed to a package wrapping station 106 by first conveyor means which comprise package pushers 108.

Figure 3:
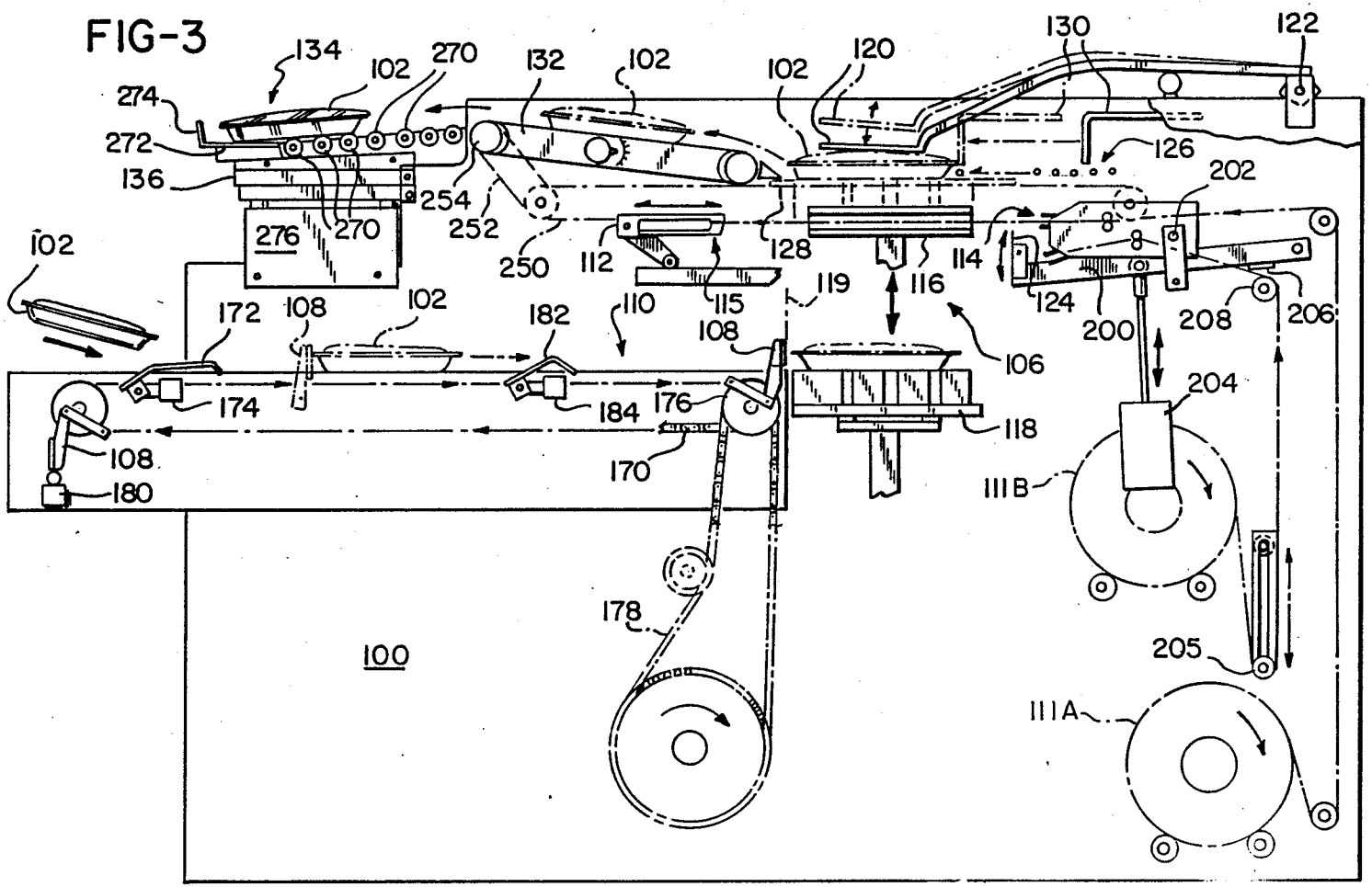
FIG. 3 is a diagrammatic vertical cross-section taken generally along the longitudinal center line of the package wrapping and weighing machine of FIG. 1.

The package 102 is carried along a package entryway 110 which includes the package infeed station 104 and extends to the package wrapping station 106. As the package 102 is conveyed along the package entryway 110 by one of the package pushers 108, a film gripper 112 has been advanced to a fixed film end engaging position 114 where the end of a continuous source or roll 111 of film is engaged by the gripper 112 and drawn into the machine 100 by retraction of the gripper 112 to the left as shown in FIG. 3 to a fixed film draw position 115. Accordingly, the film initially drawn by the film gripper 112 is of a single fixed length.

As the package 102 enters the machine 100, the width and length characteristics of the package 102 are measured to determine the width of the film to be used to wrap the package and the time during the machine wrapping operation at which the film being used to wrap the package 102 is severed from the continuous roll 111 of film, respectively, as will be described hereinafter. It is noted that, in the illustrated embodiment of the package wrapping and weighing machine 100, the width of a package refers to the package dimension across the machine and the length refers to the package dimension as fed into the machine.

The film initially drawn into the machine 100 is held in tension by the film gripper 112 and is taken by side clamps 116 which engage opposite sides of the film and stretch it outwardly toward the sides of the machine 100. By this time, the package 102 has been positioned on a package elevator 118 at a package registration edge 119 defined by one of the package pushers 108, as shown in FIG. 3. The package 102 is then elevated through the plane of the prestretched film and engages a package holddown 120. The package holddown 120 is shown in solid lines in its lowermost position in FIG. 3 and is readily removable from its mounting 122. The mounting 122 also permits the holddown 120 to pivot freely upwardly as shown in dotted lines by an amount determined by the height of a package being wrapped.

As noted, film drawn by the gripper 112 is of a fixed length since the film gripper 112 moves between the fixed film end engaging position 114 and the fixed film draw position 115. To accommodate various heights and lengths of packages to be wrapped by the machine 100, any additional film required is drawn from the continuous roll 111 of film as the package is wrapped. A first addition to the film drawn by the gripper 112 is drawn as the package is elevated through the plane of the prestretched film which is engaged by the film gripper 112 and the side clamps 116. The first additional amount of film drawn, if any, corresponds to the height of the package. Hence, a low package may draw substantially no additional film during elevation, while a high package may draw considerable additional film.

The film drawn into the machine 100 is ultimately severed by cutter means preferably comprising a heated member 124 and the film is folded under the package 102 by a rear underfolder 126 and side underfolders 128 which are activated in synchronism with the rear underfolder 126. The underfolder 126 is referred to as a rear underfolder since as the package is ejected from the wrapping station 106, the side of the package adjacent the registration edge 119 is the forward or leading side of the package, and hence, the underfolder 126 is at the rear side of the package. The general operation of the rear underfolder 126 and side underfolders 128 are well known in the art and fully described in U.S. Pat. No. 4,505,092, which is incorporated herein by reference. As previously noted, the rear edge of the film extending from the continuous roll 111 of film is severed at a time within the wrapping operation determined by the length of the package being wrapped.

Sufficient film is required for the film to be underfolded in an overlapping fashion on the bottoms of packages such that the packages can be heat-sealed. In the case of packages which have a short length, the heated member 124 severs the film immediately prior to engagement of the film by the rear underfolder 126 since sufficient film has already been drawn into the machine 100 to properly overlap on the bottom of the package. In the case of packages which are greater in length, the rear underfolder 126 will engage the film and start underfolding the rear of the film prior to severance of the film from the continuous source of film. In this way, the rear underfolder 126 draws a second addition to the film drawn by the gripper 112, as necessary, to provide complete overlapping of the underfolded film on the bottoms of longer packages. The package 102 with a film section thus drawn and underfolded on three sides is pushed out of the wrapping station 106 by a package pusher 130.

Figure 6:
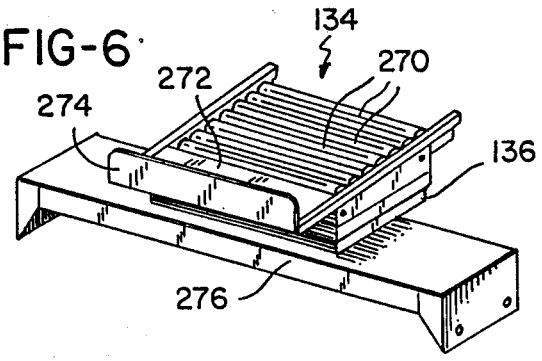
FIG. 6 shows the weighing scale and supporting shelf defining the weighing station of the package wrapping and weighing machine of FIG. 1.

As the package 102 is pushed from the wrapping station 106 by the package pusher 130, the originally-gripped free end of film is released by the film gripper 112 and folded under the package 102 by second conveyor means for carrying the package 102 from the wrapping station 106 to a weighing station 134. In the illustrated embodiment, the second conveyor means comprises a heat-sealing conveyor 132 and the weighing station 134 comprises a scale 136, as best shown in FIG. 6.

Figure 2:
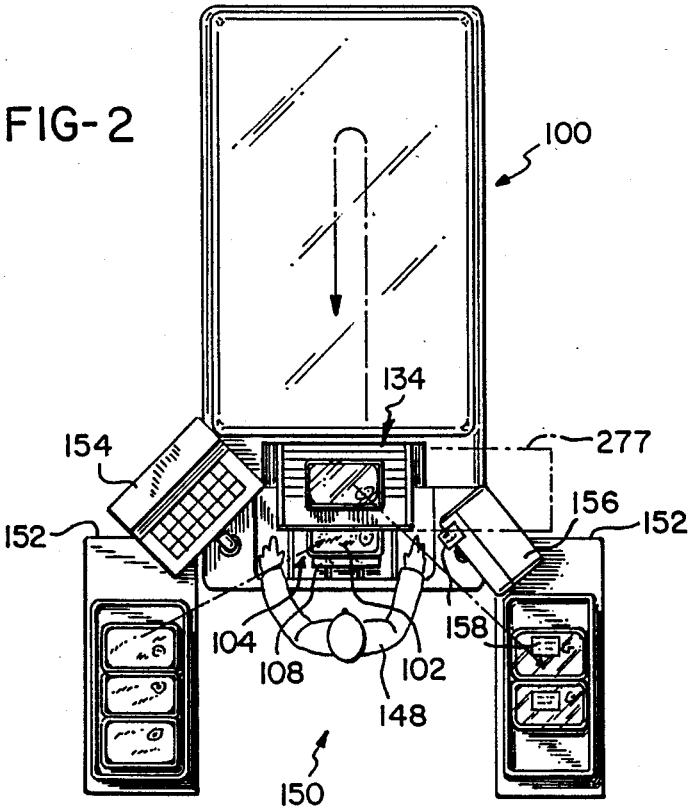
FIG. 2 is a plan view of the package wrapping and weighing machine of FIG. 1 showing the convenient operation and ergonomics for an operator of the machine.
Figure 5:
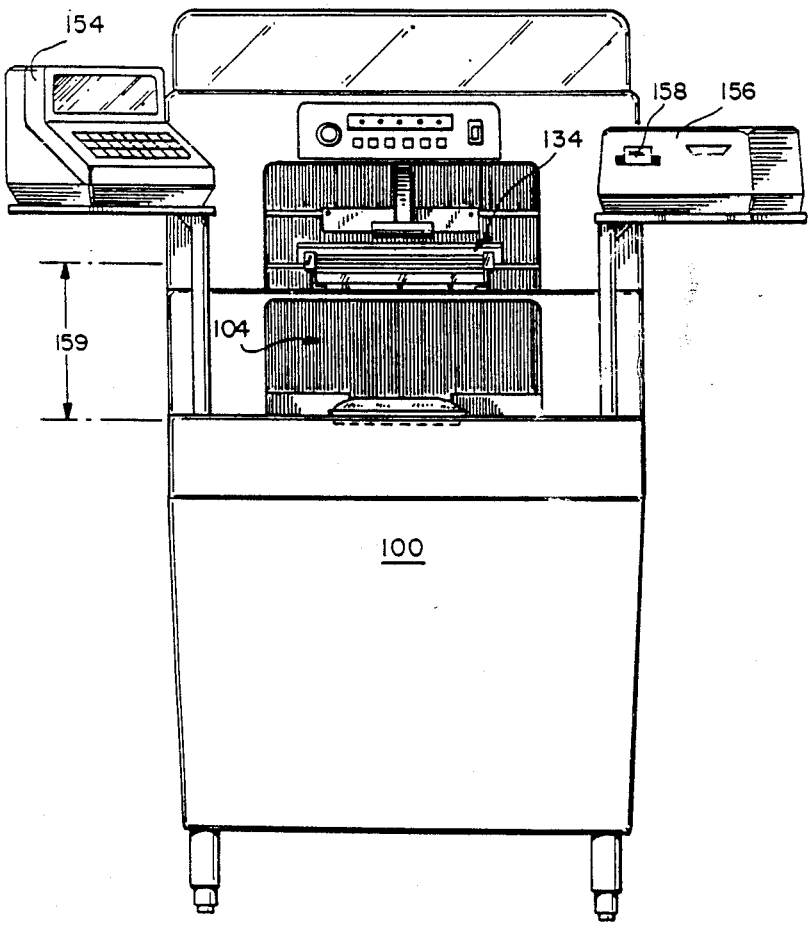
FIG. 5 is a front view of the wrapping and weighing machine as seen from the operator's position.

The convenient operation of the machine 100 can best be seen by reviewing FIGS. 1, 2 and 5. An operator 148 is shown in the operator's position 150 in FIG. 2 facing the machine 100 in front of the package infeed station 104. Tabling means comprising rolling carts 152 or the like are positioned on one or preferably both sides of the operator 148. Typically, unwrapped packages are positioned to the left of the operator 148 beneath and/or adjacent a commodity identification/pricing terminal 154 within easy reach of the operator 148. The operator 148 takes unwrapped packages from a platter supported upon the tabling means or cart 152, preferably on the left-hand side of the operator 148, and places them into the infeed station 104. The packages are carried to the wrapping station 106, wrapped and ejected onto the weighing station 134. At the weighing station 134, the packages generate weight signals which are passed to a label printer 156 positioned to the right side of the operator's position 150.

As soon as a package comes to rest on the scale 136 of the weighing station 134 and the scale 136 stabilizes, a price label 158 is generated by the label printer 156 and presented in easy reach of the operator 148. The operator 148 removes the price label 158 from the label printer 156 and applies it to the package as it is removed from the weighing station 134. The wrapped, weighed and labeled package is then placed in an orderly fashion on a platter supported upon the tabling means or cart 152, preferably on the right-hand side of the operator 148. While tabling means on both sides of the operator 148 are preferred, single tabling means can be used where space is limited.

It is apparent that at least two packages can be fed through the machine consecutively since the operator can remove the first package and label it with the label 158 prior to the second package being ejected onto the weighing station 134. Of course, a large variety of operating sequences are available depending upon the operator's preference. The actual speed of operation will depend upon the experience and ability of the operator; however, typically, a wrapping speed of 16–20 packages per minute is possible.

To make the machine 100 ergonomically advantageous for operators of a wide range of heights, the vertical separation 159 between a package supporting surface of the infeed station 104 and a package supporting surface of the weighing station 134 does not exceed 12 inches. See FIG. 5. Further, the weighing station 134 is offset from the infeed station 104 toward the wrapping station 106 to facilitate placement of packages into the infeed station 104. With the compact spacing between the infeed station 104 and the weighing station 134, the weighing station 134 is within convenient reach of the operator 148 for manually weighing packages which may be too large to be wrapped by the wrapping portion of the machine 100, or which need to be repriced for mark-downs and the like, but do not need to be rewrapped.

The first conveyor means for carrying packages from the infeed station 104 to the wrapping station 106 will now be described with reference to FIG. 3. In the illustrated embodiment, the first conveyor means comprises a pair of package pushers 108. The package pushers 108 extend above the package entryway 110 through slots 169 for engaging and pushing packages along the entryway. The package pushers 108 are carried on a circulating chain 170 which is located beneath the package entryway 110 and activated to carry a package from the infeed station 104 to the wrapping station 106 only when a package has been placed in the package infeed station 104. To this end, a package sensing element 172 is spring-biased to extend above the surface of the package infeed station 104 and engages a package presence sensing switch 174. When a package is placed into the infeed station 104, the sensing element 172 is depressed to activate the sensing switch 174 and signal a control circuit that a package is present.

The chain 170 is driven through a combination clutch/brake 176 from a continuously circulating chain 178 which is driven from the main drive mechanism of the wrapping machine in accordance with well-known wrapping art. See, for example, U.S. Pat. No. 4,505,092. The clutch portion of the combination clutch/brake 176 is activated to drive the chain 170 when a package is present in the package infeed station 104 as signaled by the sensing switch 174, and the operating position or phase of the wrapping portion of the machine 100 is at a proper stage such that the first conveyor means is synchronized with the remainder of the machine 100. This is determined by the control for the machine which will activate the clutch portion of the combination clutch/brake 176 only when the switch 174 is activated and a designated machine phase or count is indicated.

At this time, the package pusher 108, shown to the left of the first conveyor means in FIG. 3, is rotated up into a package pushing position to engage the package 102 in the infeed station 104 and push it to the registration position 119 on the elevator 118 as shown in FIG. 3. The registration position 119 is defined by the second package pusher 108 moving to the left end of the conveyor where it engages a conveyor stop switch 180 which signals the machine controller to disengage the clutch portion of the combination clutch/brake 176 and activate the brake portion thereof. By utilizing a combination clutch and brake to control the operation of the package infeed conveyor, synchronization of the infeed conveyor with the remainder of the wrapping machine is assured and the registration of packages by means of the package pushers 108 is accurately and reliably controlled.

In the illustrated embodiment, a package length sensing member 182 is spring-biased above the surface of the package entryway 110 such that package length, i.e., the dimension of the package as fed into the machine 100, can be determined by the length sensing member 182 being engaged which activates a length sensing switch 184. The width of the package, i.e., either wide or narrow, can be sensed by a width sensing member 185 placed in the package entryway 110, which activates a switch (not shown) under the entryway 110 (see FIG. 4). Alternatively, package width can be determined by means of a pair of pivotally mounted sensing arms as disclosed in U.S. Pat. No. 4,505,092, by electric sensing eyes or by any other of a variety of width sensing arrangement known in the prior art. Package width is used to select either narrow film from roll 111A or wide film from roll 111B.

By operating the first conveyor means only when a package is present in the infeed station 104, undue wear of the package conveyor is avoided, and more importantly, the package pushers 108 are not continuously circulating through the infeed station 104 such that packages may be more easily fed into the machine 100 by an operator. If the package pushers 108 continuously circulate through the infeed station 104, an operator may inadvertently place a package on top of a package pusher which may result in the package being dumped from the package entryway, improper wrapping, or jamming of the wrapping machine. To similarly avoid undue wear on the remainder of the machine 100, it will be stopped after a number of operating cycles, for example 6–8, if no package is placed into the infeed station 104.

As previously noted, the length of packages fed into the package wrapping and weighing machine 100 determines the time in the wrapping cycle at which the wrapping film is severed from the continuous roll 111 of film. In the case of a package having a short length, sufficient film is drawn into the wrapping machine 100 by the fixed length stroke of the film gripper 112 and the elevation of a package into the prestretch film such that the film may be severed at a time in the wrapping operation immediately preceding engagement of the film by the rear underfolder 126. Most short packages would be wrapped in film from the narrow film roll 111A; however, some short but wide packages could be wrapped in film from the wide film roll 111B.

Film is severed from the continuous rolls 111A, 111B by means of the heated member 124 which is mounted on one end of a pair of pivotally movable cutter bars 200. The bars 200 are pivoted about an axis 202 by means of a solenoid 204 to elevate the heated member 124 into engagement with the film which has been or is being drawn into the machine 100. In the case of the narrow film roll 111A, as shown in FIG. 3, the film is stopped and under tension due to the prestretching and elevation of the package into the film. When the narrow film is thus severed by the heated member 124, it retracts approximately ¼-inch from the severance point such that it does not rest against and foul the heated member 124, and yet the free end is readily available to the gripper 112.

In the case of the wide film roll 111B and a long package, additional film must be drawn by the rear underfolder 126 to provide sufficient film for an overlapping closure of the film sheet on the bottom of the package 102. In this instance, wide film would be used from the roll 111B and it is drawn at a rapid rate by the rear underfolder 126. To accommodate this rapid film draw, a dancing roller 205 can float upwardly during film feed from the wide film roll 111B. Since the wide film is being drawn rapidly from the roll 111B as the film is severed by the heated member 124, the film can slide over the heated member 124, tending to result in a jagged cut which is unsightly and can interfere with the operation of the film gripper 112. Such a jagged cut and the inertia of the film could result in parts of the film end resting against the heated member 124 after it is severed to thereby collect on and foul the heated member 124.

Figure 4:
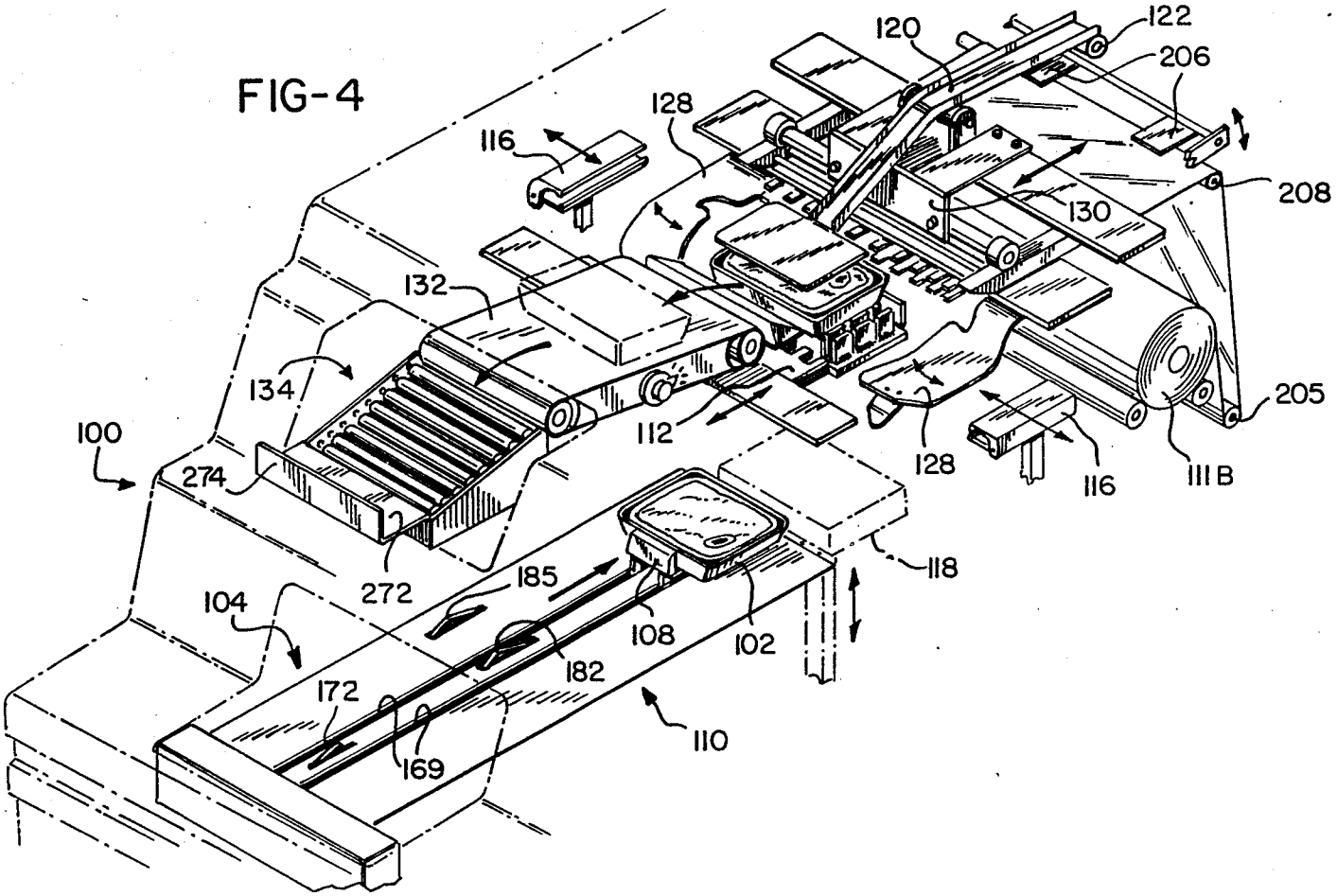
FIG. 4 is a perspective schematic view of the wrapping and weighing machine of FIG. 1.
Figure 8:
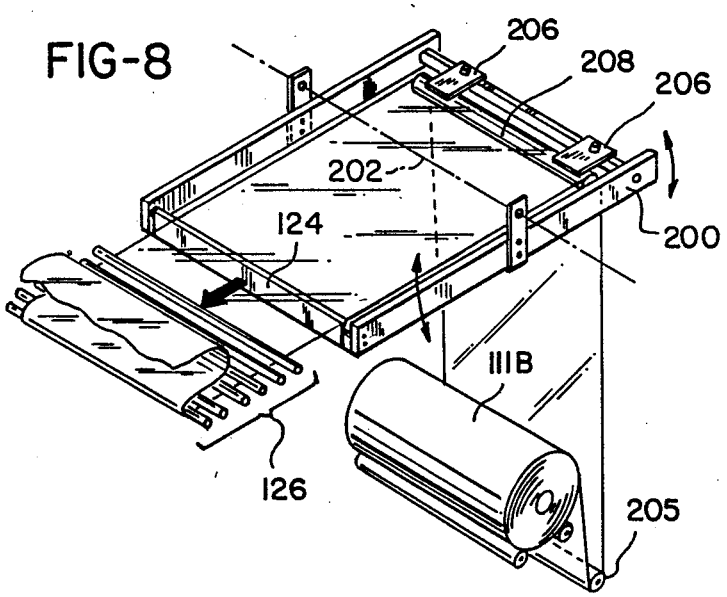
FIG. 8 shows the operation of a film severing and clamping arrangement for severing film on the fly with a heated element.

To overcome this problem, film brake pads 206 have been provided at the ends of the cutter arms 200 opposite to the heated member 124 to engage the wide film at an idler roller 208. The film brake pads 206 are oriented relative to the idler roller 208 such that they engage the film a short time before the heated member 124 engages and severs the film. In this way, the film is stopped and additional tension is placed on the section of film between the severing point defined by the heated member 124 and the idler roll 208. The stopped film is thus cleanly severed and the film end is retracted from the heated member 124 to prevent engagement of the film end with the heated member 124 after severance. The film clamping operation is best illustrated in FIGS. 3, 4 and 8. While the heated member 124 is preferred for film cutting, mechanical cutting by means of a fast-operating serrated knife or the like is possible.

The operating cycle of the machine 100 in accordance with the present invention includes a computerized controller which bases machine operation on clock counts ranging from zero to 255 similar to the operating counts in U.S. Pat. No. 4,505,092. As previously noted, the length of a package is utilized to determine the operating time of the film severing device of the machine 100 to ensure sufficient film is drawn to overlappingly cover the bottoms of packages being wrapped. In one working embodiment, such severing times have ranged from a clock count of 200 for a small, short package which is wrapped in narrow film from the roll 111A and severed prior to engagement of the rear underfolder 126 with the film, to a clock count of 216 which occurs at a time when the rear underfolder 126 has engaged and is pulling additional wide film from the roll 111B. This variation in severing times coupled with variable package heights results in film lengths ranging from approximately 13 inches to approximately 27 inches.

It should be apparent that the cutoff times can be designated substantially in direct correspondence to package lengths, or a number of package length zones can be defined with corresponding cutoff times designated for each of the zones. While it is preferred to sense package lengths as illustrated by means of the package length sensing member 182 and length sensing switch 184, it also is possible in accordance with the teachings of the present application to have an operator input package lengths such that an operator would control the film severing time by segregating packages into package length groups and designating the appropriate group length prior to wrapping, weighing and labeling those groups of packages.

After a package has been elevated into the prestretched film which is then severed at the appropriate time based on package length and underfolded by means of the rear underfolder 126 and the side underfolders 128, the thus partially wrapped package is engaged by the package pusher 130 to eject the package onto the exit conveyor which, in the illustrated embodiment, comprises a heat-sealing conveyor 132. Preferably, the package gripper 112, the package pusher 130 and the heat-sealing conveyor 132 are all controlled by a single chain 250 which is reciprocally driven by means of a cam and lever arrangement (not shown) from the main drive of the machine 100.

The heat-sealing conveyor 132 is driven by means of a secondary chain 252 and a one-way clutch 254 such that the heat-sealing conveyor 132 operates only in one direction which is to move packages positioned thereon to the weighing station 134 as shown in FIG. 3. By utilizing the intermittently driven chains 250 and 252 to drive the heat-sealing conveyor 132, the conveyor is intermittently operated in synchronism with the package pusher 130 to move the last-wrapped package toward the weighing station 134 prior to receiving the next package which is to be sealed by the heat-sealing conveyor 132. This intermittent operation also defines a fixed sealing time for each of the packages positioned on the heat-sealing conveyor 132 to help ensure thoroughly and consistently sealed, and hence, wrapped packages by operation of the machine 100.

The intermittent operation of the heat-sealing conveyor 132 ejects a wrapped and sealed package onto the weighing scale 136 which defines the weighing station 134. As best shown in FIG. 6, the weighing scale 136 preferably comprises a passive conveyor made up of a plurality of freely rotating conveyor rollers 270 which are terminated by a package braking surface 272 having a generally upwardly directed package stop 274 at its distal end to ensure that packages remain on the weighing platter. As shown in FIG. 3, most packages are stopped by the braking surface 272 such that they do not engage the upwardly directed package stop 274. Ideally, the braking surface 272 should be maintained in a clean condition such that for the largest and heaviest packages to be wrapped, the forward package edge would be closely adjacent and maybe just contact the upwardly directed package stop 274.

In any event, once a package has been stably positioned upon the weighing scale 136, stable weight signals are generated and passed to the label printer 156 where a corresponding pricing label 158 is generated and available for the operator 148 to place onto the wrapped, sealed and weighed package as it is removed from the weighing station 134. The preferred form of weighing scale is mounted on a supporting shelf 276.

Figure 7:
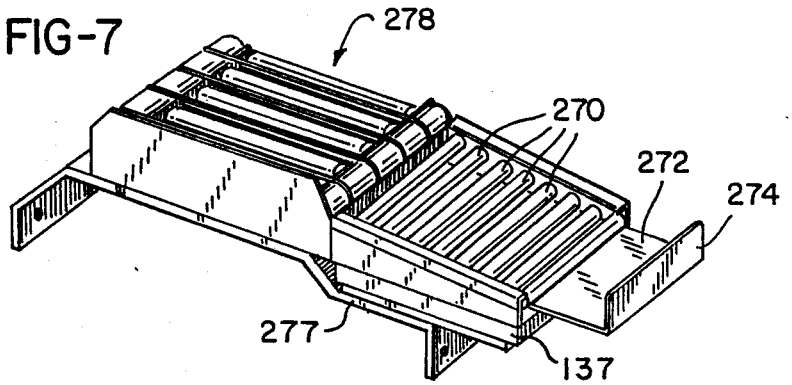
FIG. 7 shows a bidirectional conveyor and a weighing scale oriented to one side of the conveyor and a supporting shelf for connecting the bidirectional conveyor and weighing scale to the package wrapping and weighing machine of FIG. 1.

A similar weighing scale support shelf 277 is shown in FIG. 7 wherein a weighing scale 137 has been positioned to one side of the machine 100, which positioning may be desirable for certain applications and is indicated in dot-dash lines in FIG. 2. In this embodiment, a bidirectional conveyor 278, a passive 90° conveyor (not shown), or the like is positioned in alignment with and immediately above the infeed station 104. Accordingly, as a package is ejected by the intermittent operation of the heat-sealing conveyor 132, the package is conveyed through the position immediately above the infeed station 104 and then to one side or the other of the machine 100 where it comes to rest upon the weighing scale 137. It should be apparent that the terminal 154 and the label printer 156 can be positioned on either side of the machine 100, and hence, the weighing scale 137 could also be positioned to either side of the machine 100.

There are many additional advantages to the system in accordance with the present invention. For example, in the package wrapping method and machine, film is drawn to the same position 115 beyond the registration edge 119 for all package sizes, and additional film, if necessary, is drawn during package wrapping such that the film drawing mechanism and control are greatly simplified, yet film lengths are customized to package dimensions.

In the package wrapping and weighing system when the packages are removed from the weighing station 134 and hand-labeled by the operator 148, they can be directly placed in an orderly fashion upon a package supporting platter which is, in turn, supported upon one of the carts 152. In this way, the wrapped, weighed and labeled packages are ready to be carried to and placed in a display case. In automatic weighing and labeling machines of the prior art, packages are typically dumped into a bin, which can tend not only to loosen the package wrapping, but also requires the additional time required to remove the packages from the bin and place them onto platters which may then be conveyed to the display case.

Another advantage of the package wrapping and weighing system of the present invention is in systems wherein the terminal 154 includes a totalizing function. That is, the terminal 154 also provides for storing totals of various products which are wrapped, weighed and labeled by the machine. In the prior art where packages are weighed before being wrapped and labeled, typically, as soon as stable weight signals are obtained, they are passed into the totalizing memory of the terminal. Thus, if a package jams in the machine, is improperly wrapped, or otherwise damaged before it can be properly labeled, the weight which has been entered into the totalizing memory of the terminal 154 must somehow be removed and the package must be re-entered into the machine. In the system of the present invention, such a package would not have been weighed at the weighing station 134, and hence, no entry would have been made into the totalizing memory which simplifies operation of the package wrapping and weighing system of the present invention.

In the illustrated and preferred embodiments of this invention, the operator feeds unwrapped packages into the machine and wrapped packages are returned to the operator for weighing and labeling. However, it is possible to utilize the novel wrapping features in a wrapping machine wherein packages are registered in the wrapping station either to the rear of the elevator or to one side of the elevator. For such modified machines, film is fed in from the side of the elevator opposite to the registering side and wrapped packages are ejected to the registering side of the elevator rather than being returned to the operator. In a side film feed/package eject machine, package "length" and "width", as previously defined, have to be interchanged; otherwise, the foregoing description is equally applicable.

In another alternative embodiment of the invention the horizontally moving underfolding bar may be supplemented or replaced by another horizontal bar which moves vertically into engagement with the film. Movement of this other horizontal bar into engagement with the film similarly forms a loop and pulls additional film from the film source. However, in this alternative embodiment the horizontal bar moves a distance which depends upon the designated length of the package and stops. The film cutter then operates at a fixed time to produce a sheet of film of suitable length for the height and length of the package. Thereafter wrapping may proceed as disclosed for the embodiment described in the appended drawing. Additional modifications and alternate embodiments will be apparent to those skilled in the art from a review of the above disclosure.

Accordingly, while the methods described herein and the forms of apparatus for performing these methods constitute preferred embodiments of this invention, it is to be understood that the invention is not limited to these precise methods and forms of apparatus, and that changes may be made in either without departing from the scope of the invention which is defined in the appended claims.

What is claimed is:

1. A method for wrapping packages in stretch film comprising the following steps:

designating the length of a package;

operating a conveyor to carry said package to an elevator of a wrapping station and to locate said package at a registration position on one side of said elevator;

gripping a free end of a continuous source of stretch film on the side of said elevator opposite to said one side and drawing said free end over said elevator to a defined position beyond said registration position;

operating side clamps to engage the lateral edges of the film over said elevator;

elevating said package into said film to stretch said film and draw any additional film required by the height of said package from said continuous source of stretch film;

moving a horizontal bar into contact with said film at a location between said package and said film source to form a loop of film and pull from said film source a second length of additional film corresponding to the designated length of said package;

cutting said film to produce a sheet of film of suitable length for the height and length of said package;

releasing said side clamps from engagement with said film, and folding said sheet of film under said package.

2. Method according to claim 1 wherein said cutting step is performed during said movement of said horizontal bar and said folding step comprises the sub-step of causing said horizontal bar to fold the cut end of said sheet of film under said package.

3. Method according to claim 2 wherein said designating step comprises the sub-step of measuring the length of said package.

4. Apparatus for wrapping packages in stretch film comprising:

film supply means for supplying a continuous web of stretch film;

gripping means for gripping a free end of said web and pulling it to the defined position;

side clamps for clamping and thereafter releasing the two side edges of said web;

elevating means for elevating a package into said film in the region between said side clamps thereby stretching said film and drawing from said film supply means any additional film required by the height of said package;

designating means for designating the length of said package;

conveyor means for conveying said package to a registration position on said elevating means;

horizontal bar means for moving into contact with said film at a position between said film supply means and said elevating means to form a loop of film and pull from said film supply means a second length of additional film corresponding to the designated length of said package;

cutting means for cutting said film to produce a film sheet of suitable length for the length and height of said package, and folding means for folding the side edges of said film sheet under said package in synchronism with the releasing of said side edges by said side clamps.

5. Apparatus according to claim 4 wherein said cutting means comprises means for cutting said film during pulling thereof by said horizontal bar means.

6. Apparatus according to claim 5 wherein said horizontal bar means comprises means for folding the cut end of said film sheet under said package.

7. Apparatus according to claim 6 and further comprising means for measuring the length of said package.

8. Apparatus according to claim 4 wherein said side clamps comprise means for laterally stretching said film.

* * * * *